US008068759B2

(12) United States Patent
Takehara et al.

(10) Patent No.: US 8,068,759 B2
(45) Date of Patent: Nov. 29, 2011

(54) IMAGE FORMING APPARATUS AND COOLING METHOD USED THEREIN

(75) Inventors: Kenichi Takehara, Sagamihara (JP); Yasuaki Iijima, Yokohama (JP); Hiromitsu Fujiya, Kawasaki (JP); Takayuki Nishimura, Tokyo (JP); Satoshi Okano, Yokohama (JP); Tomoyasu Hirasawa, Yokohama (JP); Shingo Suzuki, Yokohama (JP); Masanori Saitoh, Komae (JP)

(73) Assignee: Ricoh Company Limited, Tokyo (JP)

( * ) Notice: Subject to any disclaimer, the term of this patent is extended or adjusted under 35 U.S.C. 154(b) by 85 days.

(21) Appl. No.: 12/621,126

(22) Filed: Nov. 18, 2009

(65) Prior Publication Data

US 2010/0129107 A1 May 27, 2010

(30) Foreign Application Priority Data

Nov. 26, 2008 (JP) ..... 2008-301013

(51) Int. Cl.
*G03G 21/20* (2006.01)

(52) U.S. Cl. ..... 399/92; 399/94

(58) Field of Classification Search ..... 399/44, 399/91, 92, 94

See application file for complete search history.

(56) References Cited

U.S. PATENT DOCUMENTS

| | | | | |
|---|---|---|---|---|
| 6,771,916 | B2 * | 8/2004 | Hoffman et al. | 399/92 |
| 6,785,490 | B2 * | 8/2004 | Tsukamoto et al. | 399/94 |
| 7,043,182 | B2 * | 5/2006 | Sakai et al. | 399/94 X |
| 7,136,613 | B2 * | 11/2006 | Sato et al. | 399/92 X |
| 7,224,921 | B2 | 5/2007 | Iijima et al. | |
| 7,356,277 | B2 | 4/2008 | Iijima et al. | |
| 7,400,842 | B2 | 7/2008 | Takehara et al. | |
| 2006/0110172 | A1 * | 5/2006 | Iijima et al. | 399/44 |
| 2006/0228128 | A1 * | 10/2006 | Reihl | 399/91 |
| 2008/0240768 | A1 * | 10/2008 | Segawa et al. | 399/92 |

FOREIGN PATENT DOCUMENTS

| | | |
|---|---|---|
| JP | 11-174795 | 7/1999 |
| JP | 2006-3819 | 1/2006 |
| JP | 2006-119234 | 5/2006 |
| JP | 4297670 | 4/2009 |

* cited by examiner

*Primary Examiner* — Sandra Brase

(74) *Attorney, Agent, or Firm* — Oblon, Spivak, McClelland, Maier & Neustadt, L.L.P.

(57) ABSTRACT

An image forming apparatus includes an image forming unit including an image carrier and a development device, a transfer unit to transfer an image formed on the image carrier onto a sheet, a fixing device to fix the image on the sheet, a sheet transport unit, a sheet stack portion, an air duct, and a first liquid-cooling device. The first liquid-cooling device includes a first heat receiving member disposed in thermal contact with a first heated portion, a first heat releaser, a first circulation pipe connecting the first heat receiving member and the first heat releaser to circulate a coolant therebetween, a first transport member to transport the coolant through the first circulation pipe, and an airflow generator to generate an airflow with external air to cool the first heat releaser. The air duct guides the air taken in by the airflow generator to a second heated portion.

20 Claims, 8 Drawing Sheets

IMAGE FORMING APPARATUS AND COOLING METHOD USED THEREIN

CROSS-REFERENCE TO RELATED APPLICATIONS

This patent specification is based on and claims priority from Japanese Patent Application No. 2008-301013, filed on Nov. 26, 2008 in the Japan Patent Office, which is hereby incorporated by reference herein in its entirety.

BACKGROUND OF THE INVENTION

1. Field of the Invention

The present invention generally relates to an image forming apparatus such as a copier, a printer, a facsimile machine, or a multifunction machine including at least two of these functions, and a method of cooling the apparatus.

2. Discussion of the Background Art

In general, electrophotographic image forming apparatuses, such as copiers, printers, facsimile machines, or multifunction devices including at least two of those functions, etc., include an exposure device to direct writing light onto an image carrier so as to form an electrostatic latent image thereon, a development device to develop the latent image with developer, a transfer unit to transfer the developed image (toner image) onto a sheet of recording media, and a fixing device to fix the toner image on the sheet. These devices include driving motors, heaters, and the like, all of which act as heat generators that generate heat. When the temperature inside the image forming apparatus is increased beyond a certain point due to the heat generated by those heat generators, the toner used to develop images might coagulate, resulting in substandard images.

Therefore, such image forming apparatuses typically include air-cooling devices composed of an air-cooling fan and an air duct, and guide external air sucked in by the air-cooling fan onto the hot portions of the apparatus through the air duct to cool the hot portions.

However, at present, the amount of space available between the various components inside the image forming apparatus continues to shrink due to increasing demand for more compact image forming apparatuses, and accordingly it is difficult to secure sufficient space for installing the air duct to cool the hot portions in the apparatus.

In view of the foregoing, certain known image forming apparatuses use a liquid-cooling device that circulate cooling liquid to cool the hot portion. The liquid-cooling device includes a heat receiving portion where the cooling liquid receives heat from the hot portion, a radiator serving as a heat releaser to release heat from the cooling liquid, and a cooling fan serving as an airflow generator to cool the radiator. The cooling liquid is circulated through a circulation pipe between the heat receiving portion and the radiator by a pump. The cooling liquid draws heat from the hot portion in the heat receiving portion and then is transported to the radiator. The radiator is cooled by the air sucked in by the cooing fan to enhance the heat release efficiency, and the air heated by the radiator is exhausted through an exhaust duct.

The cooling efficiency of the liquid-cooling device is higher than that of typical air-cooling devices. In addition, because the circulation pipe for the cooling liquid can be smaller than the air duct, installing the circulation pipe in a limited space is easier. Therefore, the liquid-cooling device is preferable to cool, for example, a development device in which space between the components is smaller, an area around the fixing device that generates a relatively large amount of heat, and sheets on which images are fixed.

Because the cost of the liquid-cooing device is higher, usage of the liquid-cooling devices is limited to the above-described portions, and the air-cooling devices are used instead in such portions that can be cooled sufficiently by the air-cooling device and have sufficient space for installing the air duct.

However, the above-described known image forming apparatus including both the air-cooling device and the liquid-cooling device has a drawback in that, because separate air-suction ducts each provided with an air-suction port are necessary for the cooling fan of the air-cooling device and that of the liquid-cooling device, the number of components increases, resulting in an increases in the size as well as the cost of the apparatus.

Therefore, there is a need to achieve efficient cooling of the hot portions in compact image forming apparatuses without increasing the cost, which known approaches fail to do.

SUMMARY OF THE INVENTION

In view of the foregoing, in one illustrative embodiment of the present invention, an image forming apparatus includes an image forming unit including an image carrier on which a latent image is formed and a development device to develop the latent image, a transfer unit to transfer the image from the image carrier onto a sheet of recording media, a fixing device to fix the image on the sheet, a sheet transport unit to transport the sheet transported from the fixing device, a sheet stack portion on which the sheet on which the image is fixed is stacked, an air duct, and a first liquid-cooling device.

The first liquid-cooling device includes a first heat receiving member disposed in thermal contact with a first heated portion of the image forming apparatus, a first heat releaser to release heat from the coolant, a first circulation pipe connecting the first heat receiving member and the first heat releaser to circulate a coolant therebetween, a first transport member connected to the first circulation pipe to transport the coolant through the first circulation pipe, and an airflow generator to generate an airflow with external air taken into the image forming apparatus to cool the first heat releaser. The first heat releaser includes a coolant flow path through which the coolant flows. The air duct guides the air taken by the airflow generator to a second heated portion of the image forming apparatus to cool the second heated portion with the air that also cools the first heat releaser.

Another illustrative embodiment of the present invention provides a cooling method used in the image forming apparatus described above. The cooling method includes generating an airflow with external air taken into the image forming apparatus by an airflow generator, drawing heat from a first heated portion of the image forming apparatus by a first heat receiving member, transmitting the heat from the first heat receiving member to a first heat releaser, cooling the first heat releaser with the air taken into the image forming apparatus, and guiding the air that has cooled the first heat releaser through an air duct of the image forming apparatus to a second heated portion of the image forming apparatus to cool the second heated portion with the air that has cooled the first heat releaser.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
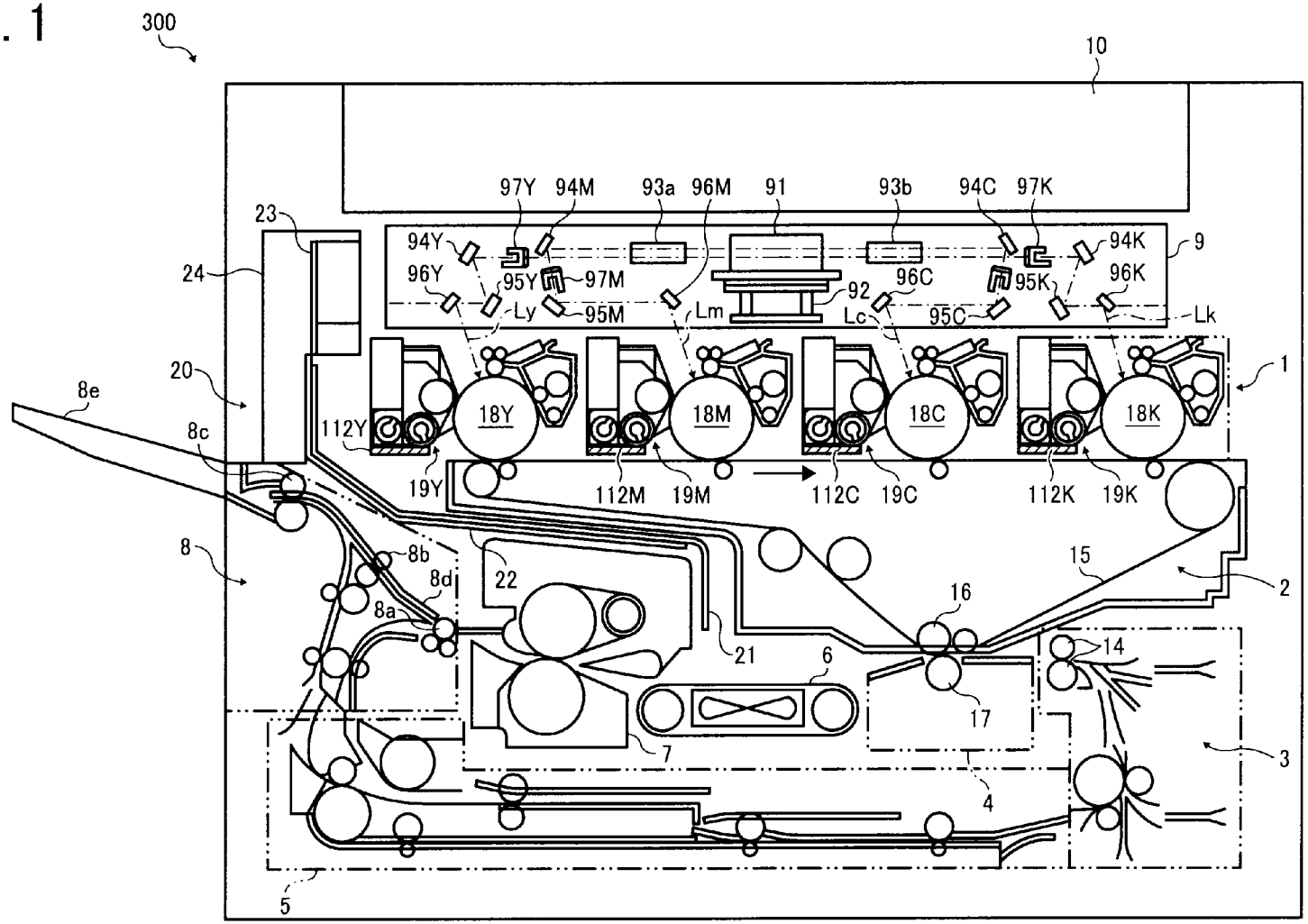
FIG. 1 illustrates a schematic configuration of an image forming apparatus according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an illustrative embodiment of the present invention is described.

FIG. 1 is a schematic diagram illustrating a configuration of an image forming apparatus 300. As shown in FIG. 1, the image forming apparatus 300 includes an image forming unit 1 that includes photoconductors 18Y, 18M, 18C, and 18K disposed in parallel. Development devices 19Y, 19M, 19C, and 19K are provided adjacent to the respective photoconductors 18Y, 18M, 18C, and 18K.

It is to be noted that the subscripts Y, M, C, and K attached to the end of each reference numeral indicate only that components indicated thereby are used for forming yellow, magenta, cyan, and black images, respectively, and hereinafter may be omitted when color discrimination is not necessary.

An exposure unit 9 serving as a latent image forming device is provided above the image forming unit 1 and includes a polygon mirror 91 shaped like a regular polygonal prism, a polygon motor 92, f-θ lenses 93*a* and 93*b*, and light sources, not shown, such as laser diodes disposed on a side face of the exposure unit 9. In the present embodiment, the polygon mirror 91 is hexagonal, and a reflection mirror is disposed on each of the six sides. The polygon mirror 91 rotates at high velocity on an identical rotation axis, driven by the polygon motor 92, and thus the polygon mirror 91 and the polygon motor 92 together form a deflection unit. With this configuration, when the light sources emit writing light (e.g., laser beams Ly, Lm, Lc, and Lk), the polygon mirror 91 deflects the laser beams L to scan across surfaces of the respective photoconductors 18.

The laser beams Ly and Lm for yellow and magenta, deflected in a main scanning direction by the polygon mirror 91, are arranged vertically and pass through the f-θ lens 93*a*, and thus the equiangular movement in the main scanning direction by the polygon mirror 91 is converted into uniform-velocity movement. By contrast, the laser beams Lc and Lk for cyan and black pass through the f-θ lens 93*b* disposed across the polygon mirror 91 from the f-θ lens 93*a*.

The exposure unit 9 includes four reflection optical systems each of which includes the laser diode, not shown, first, second, and third reflection mirrors 94, 95, and 96, and a long lens 97. These reflection mirrors do not function as lenses.

After passing through the f-θ lens 93*a* or 93*b*, the laser beams Ly, Lm, Lc, and Lk enter the respective reflection optical systems for yellow, magenta, cyan, and black. More specifically, each leaser beam L is reflected sequentially on the long lens 97, the first reflection mirror 94, the second reflection mirror 95, and the third reflection mirror 96, thus reflected three times, and is directed onto the surface of the photoconductor 18.

The image forming apparatus 300 further includes a reading unit 10 disposed in an upper portion thereof, a transfer unit 2 including an intermediate transfer belt 15, disposed beneath the image forming unit 1, and a secondary transfer unit 4 including a secondary transfer roller 17, disposed beneath the transfer unit 2. The intermediate transfer belt 15 is looped around multiple support rollers and rotates clockwise in FIG. 1. The secondary transfer roller 17 presses against a facing roller 16 via the intermediate transfer belt 15, and thus a secondary transfer nip is formed between the secondary transfer roller 17 and an outer circumferential surface of the intermediate transfer belt 15. The secondary transfer roller 17 receives a secondary transfer bias from a power source, not shown, and the facing roller 16 is grounded electrically, thus forming a secondary transfer electrical field in the secondary transfer nip.

The image forming apparatus 300 further includes a fixing device 7 disposed on the left of the secondary transfer unit 4 in FIG. 1 to fix a toner image formed on a sheet of recording media. The fixing device 7 includes a heating roller inside which a heat generator is provided. A transport belt 6 provided between the secondary transfer unit 4 and the fixing device 7 transports the sheet onto which the image is transferred to the fixing device 7. A sheet transport unit 3 is provided in a lower portion of the image forming apparatus 300 and feeds sheets from a sheet cassette, not shown, one by one to the secondary transfer unit 4.

Further, a discharge unit 8 is provided downstream from the fixing device 7 in a direction in which the sheets are transported (hereinafter "sheet transport direction") to transport the sheet that has passed the fixing device 7 outside or to a duplex unit 5 disposed in a lower portion in FIG. 1. The discharge unit 8 includes a first transport roller 8*a*, a second transport roller 8*b*, a discharge roller 8*c*, and a sheet guide plate 8*d*.

Figure 3:
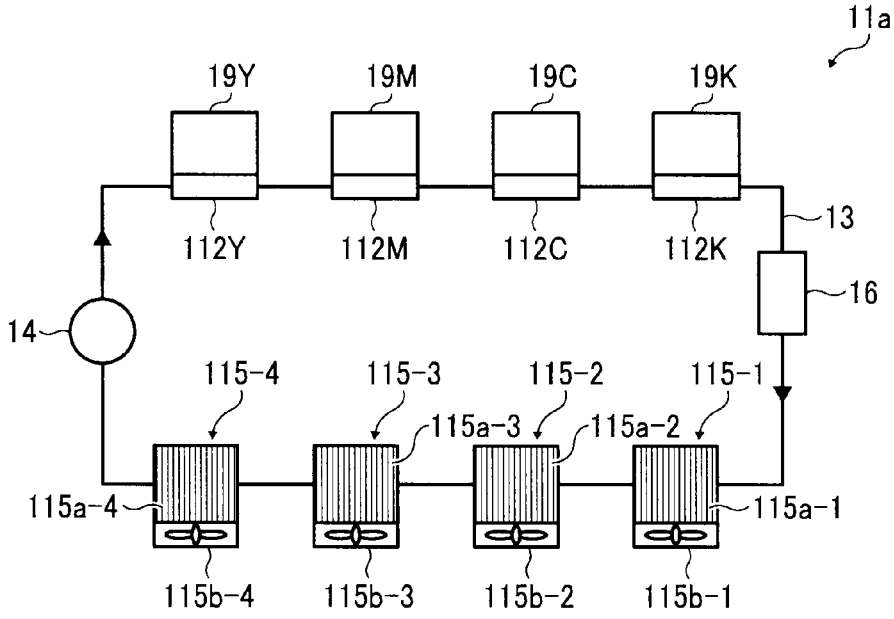
FIG. 3 schematically illustrates a configuration of a first liquid-cooling device according to an illustrative embodiment.

It is to be noted that, in FIG. 1, reference characters 112Y, 112M, 112C, and 112K represents heat receiving plates of a first liquid-cooling device 11*a* (shown in FIG. 3).

Next, a copying operation using the above-described image forming apparatus is described below with reference to FIG. 1.

Initially, the apparatus reads image data of original documents with the reading unit 10. In conjunction with image data reading, the intermediate transfer belt 15 starts rotating clockwise in FIG. 1, and simultaneously, the exposure unit 9 scans the photoconductors 18 in the image forming unit 1 with the respective laser beams L according to yellow, magenta, cyan, and black image data, thus forming the electrostatic latent images on the photoconductors 18. Then, the development units 19 develop the latent images on the respective photoconductors 18 into single-color images, which are then transferred from the photoconductors 18 and superimposed one on another on the intermediate transfer belt 15 to form a multicolor toner image.

In conjunction with the above-described toner image formation, sheets are fed one by one from the sheet cassette, not shown, and then a pair of registration rollers 14 stops the sheet by sandwiching a leading edge portion of the sheet therebetween. Then, the registration rollers 14 rotate to forward the sheet between the intermediate transfer belt 15 and the secondary transfer unit 4, so that the arrival of the sheet is timed to coincide with the formation of the multicolor toner image on the intermediate transfer belt 15. Then, the secondary transfer unit 4 transfers the toner image from the intermediate transfer belt 15 onto the sheet, after which the transport belt 6 transports the sheet to the fixing device 7, where the toner image is fixed on the sheet with heat and pressure in a fixing process. Then, the sheet is transported to the discharge unit 8. In the discharge unit 8, a switch pawl, not shown, can switch the destination of the sheet between the duplex unit 5 and a discharge tray 8*e* disposed on an outer side of the apparatus. The duplex unit 5 reverses the sheet and again sends the sheet to the secondary transfer nip, where the secondary transfer roller 17 presses against the intermediate transfer belt 15 so that another image is formed on a back side of the sheet if necessary. Then, the sheet is discharge onto the discharge tray 8*e*. After the toner image is transferred therefrom, the intermediate transfer belt 15 is cleaned by a cleaning device, not shown, as a preparation for subsequent image formation.

In the present embodiment, to make the image forming apparatus 300 compact, in addition to arranging the devices densely in the apparatus, the fixing device 7 is disposed beneath the transfer unit 2. In the configuration shown in FIG. 1, the intermediate transfer belt 15 curves to cover an upper side as well as a side of the fixing device 7 to reduce the height as well as the width of the image forming apparatus 300.

However, when the fixing device 7, which generates heat, is disposed adjacent to the intermediate transfer belt 15, the intermediate transfer belt 15 might be affected thermally, causing image failure such as color deviation. This inconvenience can occur more frequently as the printing speed is increased, thereby increasing the amount of heat generated in the apparatus. Additionally, in duplex printing, because the sheet heated by the fixing device 7 passes through the duplex unit 5 and then again contacts the intermediate transfer belt 15 at the secondary transfer nip, the temperature of the intermediate transfer belt 15 is further increased by the heat transmitted from the sheet, degrading the image forming conditions. The heat can further transmitted to the photoconductors 18 contacting the intermediate transfer belt 15 and to the development devices 19. Thus, it can possible that image failure due to deformation of the intermediate transfer belt 15 and solidification of toner might occur more frequently.

Therefore, in the present embodiment, a thermal insulation device 20 is provided between the fixing device 7 and the intermediate transfer belt 15 disposed adjacent to the fixing device 7. The thermal insulation device 20 in the present embodiment, described below, is a heat pipe type although airflow type insulation device using a duct may be used.

Figure 7:
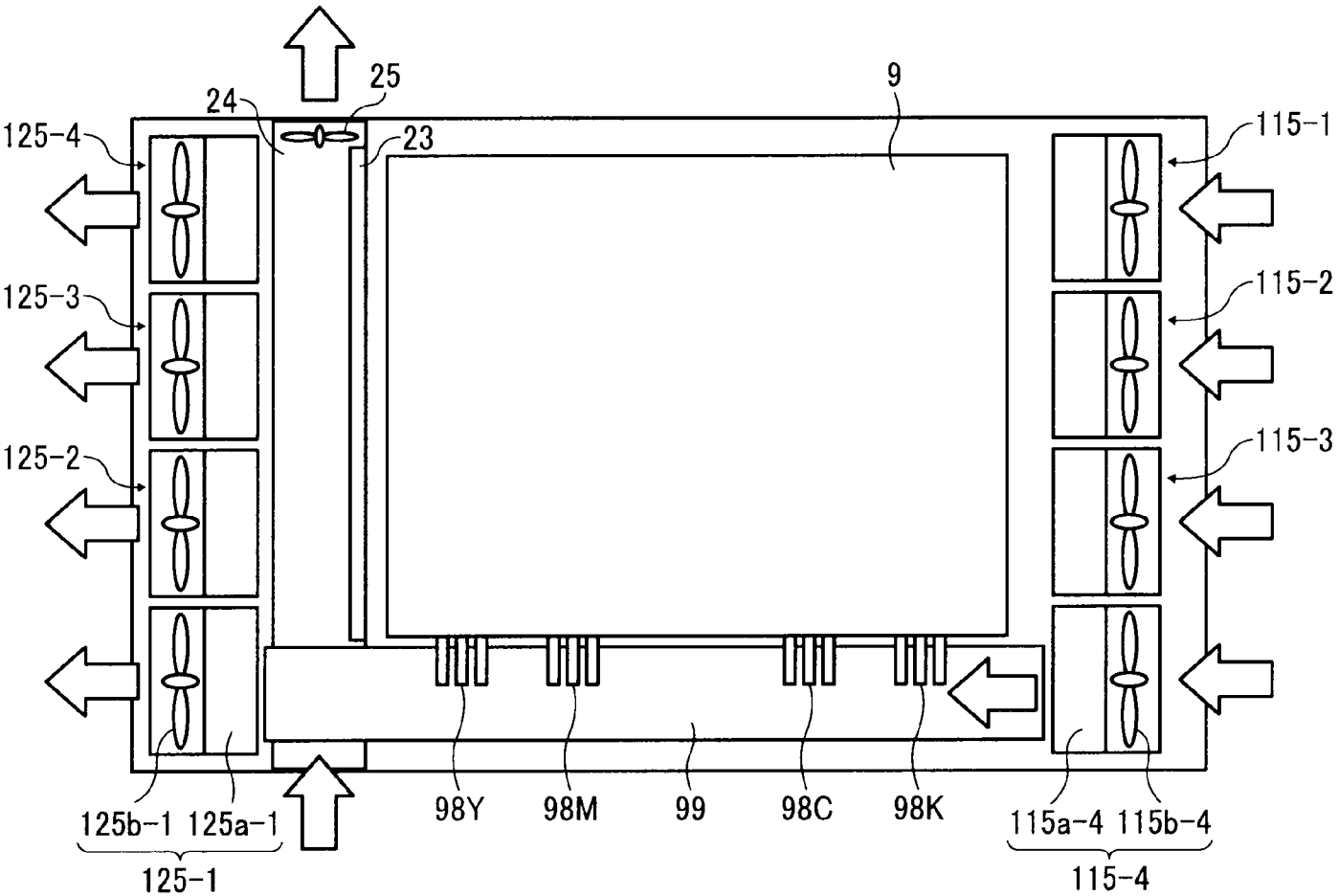
FIG. 7 schematically illustrates a configuration around an exposure unit in the image forming apparatus shown in FIG. 1.

The thermal insulation device 20 includes a heat receiving plate 21 serving as a heat receiving member, a heat pipe 22 serving as a heat transmission or transport member, a heat releasing plate 23 serving as a heat releaser, a duct 24, and an exhaust fan 25 shown in FIG. 7. The heat receiving plate 21 is formed of a material capable of absorbing heat easily, for example, metal such as aluminum or copper, and is disposed between the fixing device 7 that is a heat source (heat generator) and the transfer unit 2, which is an object to be protected from the heat from the heat source. The heat pipe 22 is attached to a lower surface of the heat receiving plate 21, and its lower end portion serves as a heat receiving portion. The other end portion of the heat pipe 22 serves as a heat releasing portion and is attached to the heat releasing plate 23 at a portion higher than the heat receiving portion. The heat releasing plate 23 is formed of a material capable of releasing heat easily. The thermal insulation device 20 can further include a heat sink as required. The duct 24 extends from a front side (lower side in FIG. 7) to a back side (upper side in FIG. 7) of the image forming apparatus 300 in the present embodiment and the heat releasing plate 23 is disposed inside the duct 24. An air inlet, not shown, is provided on an end portion of the duct 24 on the front side of the apparatus, and an exhaust port is provided on another end portion of the duct 24 on the back side. The exhaust fan 25 (shown in FIG. 7) is disposed in the exhaust port. Thus, air flows through the duct 24 from front to back of the apparatus.

In the thermal insulation device 20 configured as described above, the heat receiving plate 21 receives the heat from the heat source that in the configuration shown in FIG. 1 is the fixing device 7, and the heat pipe 22 transmits the heat to the heat releasing plate 23 serving as the heat releaser. Then, the heat releasing plate 23 present in the duct 24 releases the heat, which is sent outside the image forming apparatus 300 by the exhaust fan, not shown. It is to be noted that, the thermal insulation device 20 can employ natural cooling without using the exhaust fan. Thus, protecting the image forming unit 1, the transfer unit 2, and the like from the heat from the fixing device 7 by blocking the heat can prevent or reduce the occurrence of image failure due to the deformation of the intermediate transfer belt 15 and solidification of toner.

The development units 19 also generate heat and thus serve as heat generators. Although not shown in drawings, each development device 19 includes a developer carrier (e.g., development sleeve), an agitation-transport member (e.g., screw) to agitate and transport the developer in the development device 19, and a regulation member (e.g., doctor blade) to adjust the layer thickness of the developer carried on the developer carrier. When the agitation-transport member is driven, frictional heat is generated through sliding contact between the agitation-transport member and the developer as well as that among developer particles, raising the temperature inside the development device 19. In addition, frictional heat generated through sliding contact between the regulation member and the developer as well as that among developer particles adjusted by the regulation member raise the temperature inside the development device 19.

The increase in the temperature inside the development device 19 can reduce toner charge amount, and since the toner charge determines image density of the formed image, a desired image density cannot be obtained. Moreover, the increase in the temperature can fuse the toner to adhere to the regulation member, the development carrier, and/or the photoconductor 18, which can cause image failure such as appearance of lines in the images. In particular, when toner whose melting temperature is lower is used to reduce the energy required for fixing, it is possible that such toner adherence might occur easily, resulting in substandard images. Another factor increasing the temperature inside the development units 19 is an increase in the printing speed.

Therefore, it is important to cool the development units 19 to attain high-quality images and high reliability. Although the area around the development units 19 may be air-cooled with an airflow generated by an air-cooling fan, air ducts to form an airflow path around the development units 19 are reduced in size due to the need to make the apparatus compact. However, such smaller air ducts reduce the amount of the air flowing around the development units 19 accordingly, which can prevent sufficient cooling of the development units 19.

Additionally, the sheets after passing through the fixing device 7 (hereinafter "sheets after the fixing process") are heated to be close to 100° C. and release the heat while being transported, thus contributing to an increase in the temperature inside the image forming apparatus 300. Particularly when duplex printing is continuously executed, the temperature inside the apparatus tends to increase because the heated sheets that have passed through the fixing device 7 sequentially pass the duplex unit 5, the sheet transport unit 3, the secondary transfer nip, and the transport belt 6. Although the sheets thus heated in the fixing process should be cooled, it may be difficult for air-cooling devices to cool the sheets sufficiently because the sheets are hotter.

Therefore, the present embodiment uses a first liquid-cooling device 11*a* (shown in FIG. 3) and a second liquid-cooling device 11*b* (shown in FIG. 5) to cool the development devices 19 and the sheets after the fixing process, respectively.

First, a basic configuration of the liquid-cooling devices according to the present embodiment is described below using a liquid-cooling device 11 shown in FIG. 2.

Figure 2:
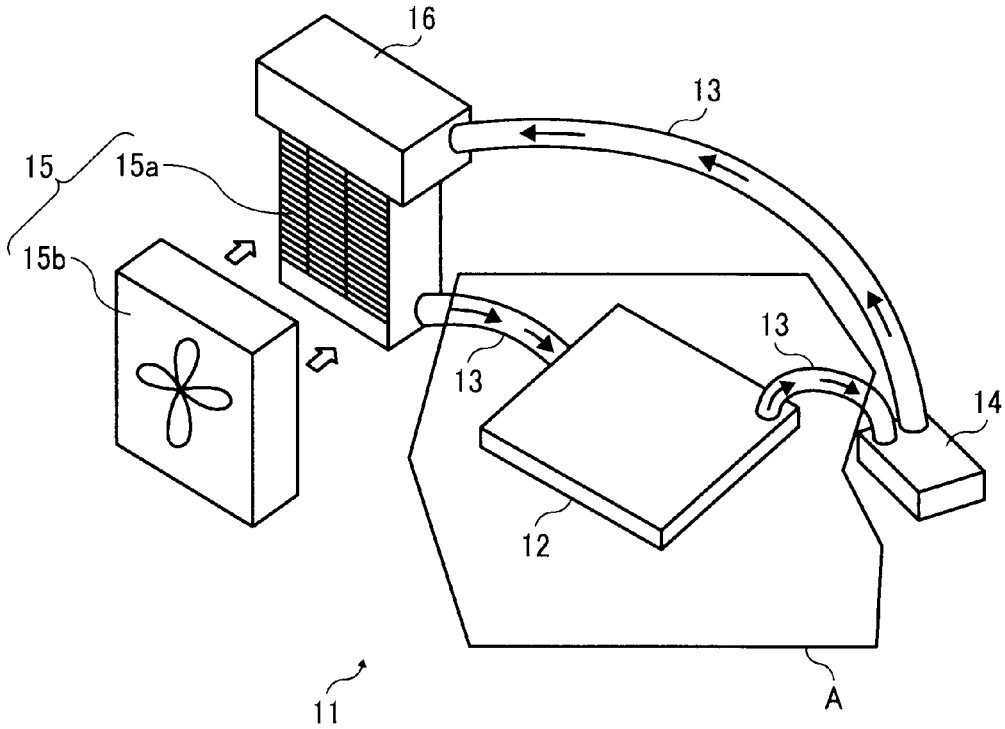
FIG. 2 illustrates a liquid-cooling device according to an illustrative embodiment.

Referring to FIG. 2, the liquid-cooling device 11 includes a heat receiving plate 12 serving as a heat receiving member, a circulation pipe 13 through which coolant is circulated, a pump 14 serving as a transport member, a cooling unit 15, and a reserve tank 16. The cooling unit 15 includes a radiator 15*a*, serving as a heat releaser, and a cooing fan 15*b*, serving as a cooling airflow generation member.

The heat receiving plate 12 is formed of a material capable of absorbing heat easily, for example, a metal such as aluminum or copper and is disposed in thermal contact with a heated portion A. A coolant channel, not shown, is formed on the heat receiving plate 12. The coolant flows though the coolant channel that may be attached to or embedded in the heat receiving plate 12 and draws heat from the heated portion A to be cooled. Alternatively, the heat receiving plate 12 itself can form the coolant channel.

It is to be noted that "in thermal contact with a heated portion A" means that the heat receiving plate 12 contacts the heat from the heated portion A so that the heat receiving plate 12 can receive heat from the heated portion A. In other words, the heat receiving plate 12 may be disposed to directly contact the heated portion A or across a given gap from the heated portion A. The heat receiving plate 12 receives heat from the heated portion A and then transmits the heat to the coolant flowing through the coolant channel efficiently.

The coolant that has drawn the heat from the heated portion A flows through the circulation pipe 13 to the cooling unit 15, where the coolant is cooled, that is, the heat drawn from the heated portion A is transmitted to the radiator 15*a* of the cooling unit 15. Then, the coolant is returned to the heat receiving plate 12 through the circulation pipe 13, thus circulated through the circulation pipe 13. The circulation pipe 13 can be an aluminum pipe, a rubber tube, or the like. The specific material used can be varied depending on the place where the circulation pipe 13 is installed.

In the cooling unit 15, the radiator 15*a* transmits and releases the heat of the coolant via a container, formed of a material having a higher thermal conductivity such as aluminum, containing the coolant. Depending on the amount of the heat, the heat is released through forced air-cooling using the cooling fan 15*b* or natural cooling. The pump 14 is a driving source to circulate the coolant between the heat receiving plate 12 and the cooling unit 15 as indicated by arrows shown in FIG. 2. The reserve tank 16 is used to store the coolant. Propylene glycol type antifreeze can be used as the coolant, which serves as heat transport medium to transport the heat from the heat receiving plate 12 to the radiator 15*a*.

The first liquid-cooling device 11*a* to cool the development units 19 is described below with reference to FIG. 3, which schematically illustrates a configuration of the first liquid-cooling device 11*a*.

Referring to FIG. 3, the first liquid-cooling device 11*a* includes the four heat receiving plates 112Y, 112M, 112C, and 112K, which are connected serially. The first liquid-cooling device 11*a* further includes four cooling units 115-1, 115-2, 115-3, and 115-4 (hereinafter collectively "cooling units 115"). It is to be noted that the number of the cooling units is not limited to four but can be one or five or more, for example. The cooling units 115 respectively include radiators 115*a*-1, 115*a*-2, 115*a*-3, and 115*a*-4 (hereinafter collectively "radiators 115*a*"), and adjacent cooling fans 115*b*-1, 115*b*-2, 115*b*-3, and 115*b*-4 (hereinafter collectively "cooling fans 115*b*"). Alternatively, a single cooling fan 115*b* may be used to supply external air to all the radiators 115*a*. As described above using the liquid-cooling device 11 shown in FIG. 2, the coolant is stored in a reserve tank 16 and circulated between the heat receiving plates 112 and the cooling units 115 by a pump 14 through a circulation pipe 13. The coolant flows in the direction indicated by arrows in FIG. 3 (hereinafter "coolant flow direction or cooling direction").

Thus, by using the multiple cooling units 115, temperature increase in the four development devices 19 can be reliably restricted even when the cooling efficiency of each cooling unit 115 individually is relatively low. As a result, the heat-releasing area and the cooling efficiency of the radiators 115*a* can be smaller, and accordingly the radiator 115*a* can be smaller, compared with a configuration in which only a single cooling unit is used for the four development units 19.

By cooling the image forming unit 1 as the first heated portion, melting of the toner and insufficient charging of the toner can be prevented or reduced. In particular, by cooling the development devices 19 that generate heat and can become the hottest parts of the image forming unit 1, the image forming unit 1 can be cooled efficiently. Additionally, even in a relatively compact image forming apparatus in which the space around the developments devices 19 is limited, the heat receiving plates 112 and the circulation pipe 13, which requires a space smaller than the space required for components of the air-cooling device, can still be installed.

Variations of the first liquid-cooling device 11*a* for the development units 19 are described below with reference to FIGS. 4A and 4B.

Figure 4A:
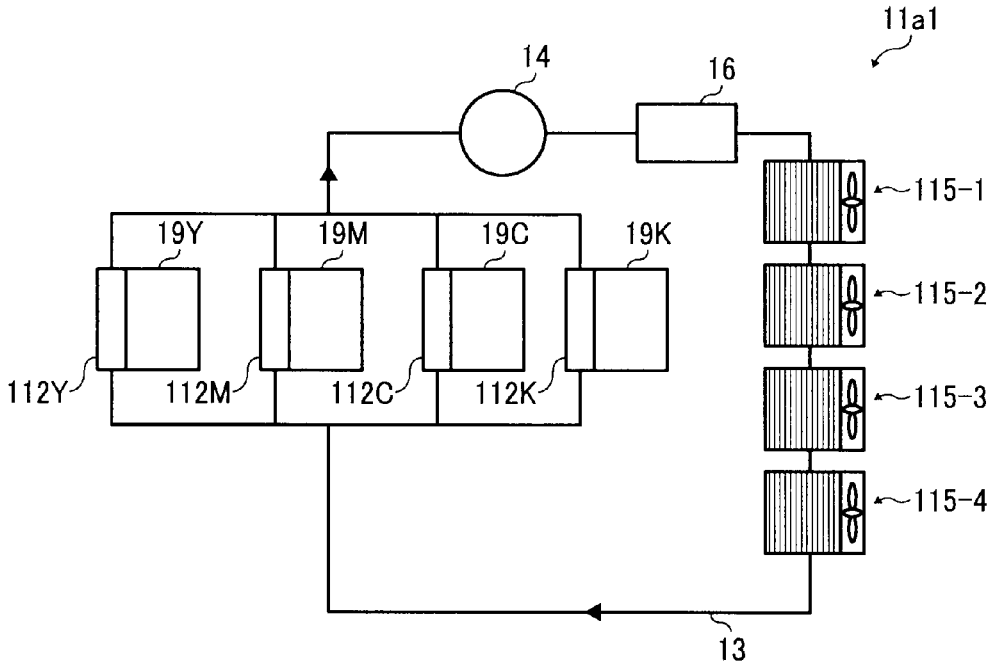
FIGS. 4A and 4B illustrates other configurations of the first liquid-cooling device.

Specifically, the heat receiving plates 112 may be arranged in parallel as in a first liquid-cooling device 11*a*1 shown in FIG. 4A.

Figure 4B:
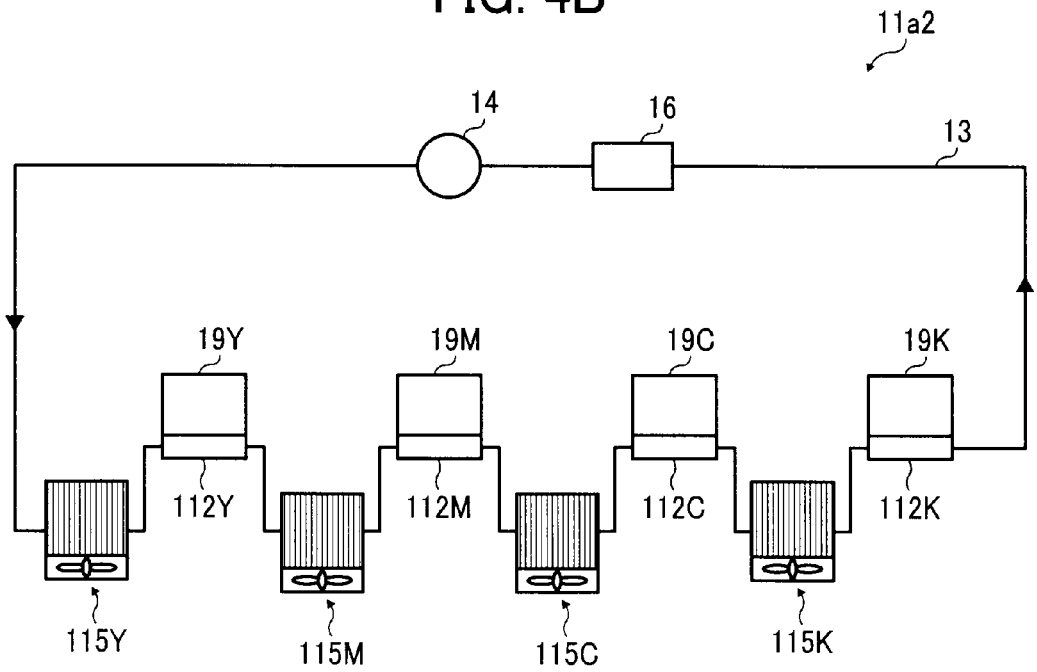

Additionally, in a first liquid-cooling device 11*a*2 shown in FIG. 4B, four cooling units 115Y, 115M, 115C, and 115K correspond to the respective development devices 19Y, 19M, 19C, and 19K, and the circulation pipe 13 are configured to prevent the coolant cooled in each cooling unit 115 (e.g., 115Y) from flowing to the heat receiving plates 112 provided in other development devices 19 (e.g., 19M, 19C, and 19K) while flowing to the heat receiving plate 112 provided in the corresponding development device 19 (e.g., 19Y). In the configuration shown in FIG. 4B, each heat receiving plate 112 can receive the coolant cooled by the corresponding cooling unit 115 disposed upstream from that heat receiving plate 112. Therefore, only a necessary amount of the cooled coolant for cooling the corresponding development device 19 can be supplied thereto, thus preventing or restricting excessive cooling of the development device 19. As a result, condensation on the development units 19 can be eliminated or reduced.

In the present embodiment, each heat receiving plate 112 is disposed contacting a lower portion of the corresponding development device 19. In the development device 19, temperature can be highest in the lower portion where the agitation-transport member (e.g., screw), not shown, is disposed because frictional heat is generated through sliding contact between the agitation-transport member and the developer as well as sliding contact among developer particles. Therefore, each development devices 19 can be cooled more efficiently by disposing the heat receiving plate 112 in the lower portion to cool it forcibly.

Next, the second liquid-cooling device 11*b* to cool the sheets after the fixing process is described below with reference to FIGS. 5, 6A, and 6B.

Figure 5:
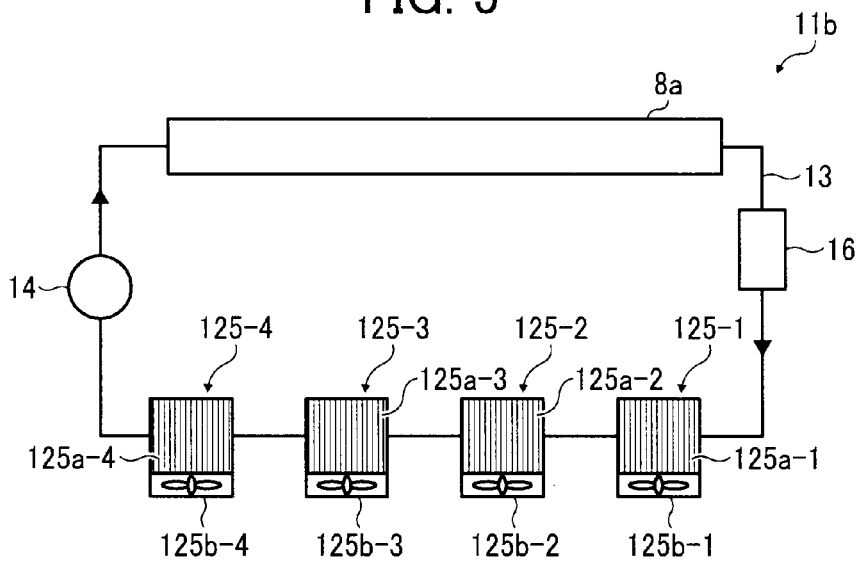
FIG. 5 schematically illustrates a configuration of a second liquid-cooling device according to an illustrative embodiment.

FIG. 5 illustrates a schematic configuration of the second liquid-cooling device 11*b*.

Referring to FIG. 5, the second liquid-cooling device 11*b* uses the first transport roller 8*a* of the discharge unit 8 (shown in FIG. 1) as a heat receiving member. Similarly to the first liquid-cooling device 11*a* shown in FIG. 3, the second liquid-cooling device 11*a* includes four cooling units 125-1, 125-2, 125-3, and 125-4 (hereinafter collectively "cooling units 125"), the number of witch is not limited to four but can be one or five or more, for example. The cooling units 125 respectively include radiators 125*a*-1, 125*a*-2, 125*a*-3, and 125*a*-4 (hereinafter collectively "radiators 125*a*"), cooling fans 125*b*-1, 125*b*-2, 125*b*-3, and 125*b*-4 (hereinafter collectively "cooling fans 125*b*"). Alternatively, a single cooling fan 125*b* may be used to supply external air to all the radiators 125*a*. Similarly to the first liquid-cooling device 11*a* shown in FIG. 3, the coolant is stored in a reserve tank 16 and circulated between the first transport roller 8*a* and the cooling units 125 by a pump 14 through a circulation pipe 13.

Figure 6A:
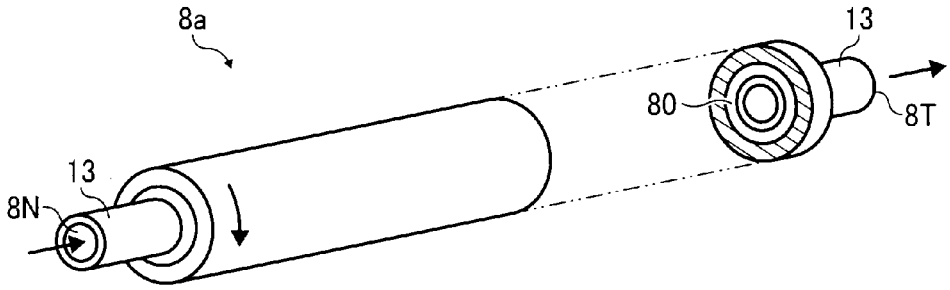
FIG. 6A is a schematic perspective view of a first transport roller.
Figure 6B:
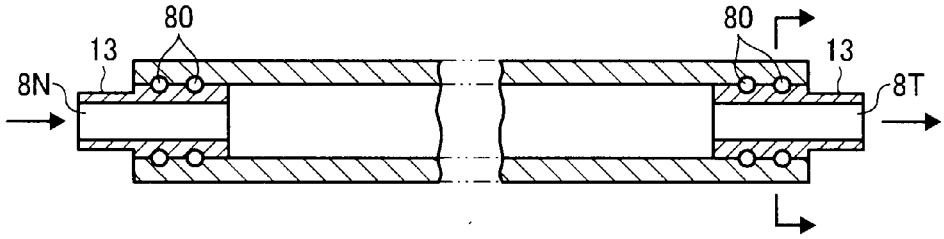
FIG. 6B is a schematic cross-sectional view of the first transport roller shown in FIG. 6A.

FIG. 6A is a schematic perspective view of the first transport roller 8*a* serving as the heat receiving member, and FIG. 6B is a cross-sectional view of the first transport roller 8*a*.

The first transport roller 8*a* is a hollow tube and rotatably fits around the circulation pipe 13, which does not rotate, via rubber rings 80 that act as seals. The coolant flows from a coolant inlet 8N in one end portion to a coolant outlet 8T in the other end portion in FIGS. 6A and 6B as indicated by arrows shown in FIGS. 6A and 6B. Because the first transport roller 8*a* rotates, the rubber rings 80 rotatably support the first transport roller 8*a* while preventing leakage of the coolant.

The first transport roller 8*a* draws heat from the sheets while the sheets passes the first transport roller 8*a*, thus cooling the sheets that are heated portions.

Alternatively, instead of the first transport roller 8*a*, the second transport roller 8*b* and/or the discharge roller 8*c* may be used as the heat receiving member, employing the same configuration as that described above. Yet alternatively, the sheets may be cooled by multiple rollers, for example, the first transport roller 8*a*, the second transport roller 8*a*, and the discharge roller 8*c*, connected serially or in parallel.

Additionally, the second liquid-cooling device 11*b* may cool the discharge unit 8 serving as a sheet transport unit in addition to the sheets after the fixing process. For example, a heat receiving plate may be attached to the sheet guide plate 8*d*, and the first transport roller 8*a* and the heat receiving plate attached to the sheet guide plate 8*d* can be connected serially or in parallel so that the second liquid-cooling device 11*b* can cool both the sheets after the fixing process and the discharge unit 8.

Similarly, the second liquid-cooling device 11*b* may be configured to cool the duplex unit 5 in addition to the sheets after the fixing process. Also in this case, for example, a heat receiving plate can be attached to a sheet guide plate of the duplex unit 5, and the first transport roller 8*a* and the heat receiving plate attached to the sheet guide plate can be connected serially or in parallel so that the second liquid-cooling device 11*b* can cool both the sheets after the fixing process and the duplex unit 5.

Moreover, the second liquid-cooling device 11*b* may be configured to cool the discharge tray 8*e* disposed outside the image forming apparatus 300, a housing of the fixing device 7, and/or the heat receiving plate 21 to cool the vicinity of the fixing device 7.

In other words, in the present embodiment, the second liquid-cooling device 11*b* cools at least one of the sheets after the fixing process, the fixing unit 7, the vicinity of the fixing unit 7, the discharge unit 8 and the duplex unit 5 that transport the sheets after the fixing process, and the discharge tray 8*e* on which the sheets are stacked after images are fixed thereon.

A description is given below of a configuration of a cooling system formed by multiple cooling devices used in the image forming apparatus.

It is to be noted that there are other portions, such as the exposure unit 9, to be cooled in addition to the above-described development units 19, the sheets after the fixing process, the fixing unit 7 and its vicinity, the discharge unit 8, the duplex unit 5, and the discharge tray 8*e*.

Thus, for example, the exposure unit 9 should be cooled because the exposure unit 9 includes heat generators such as the polygon motor 92, and CPUs (Central Processing Units) respectively implemented on control boards, not shown, to control the polygon motor 92 and the light sources, not shown. An air-cooling device, whose cost is lower, can be used to cool the exposure unit 9 because its vicinity can accommodates ducts for air-cooling and is not as hot as the sheets after the fixing process. However, cooling the exposure unit 9 by an air-cooling device means that another air-cooling fan, a suction duct, and the like are necessary, and thus the number of the components increases. Moreover, increasing the number of the fans increases noise. Accordingly, the power consumption, the cost, the noise, and the size of the apparatus can increase, which is not desirable.

In the first liquid-cooling device 11*a* shown in FIG. 3 to cool the development devices 19, because the temperature of the radiators 115*a* typically does not increases significantly, the temperature of the airflow that is generated by the cooling fans 115*b* and which has been used to cool the radiators 115*a* increases by only limited degrees. Accordingly, it is inefficient and wasteful if the airflow used to cool the radiators 115*a* is discharged outside because this airflow can be used to cool the exposure unit 9.

Moreover, because the sheets after the fixing process are very hot, the radiators 125*a* of the second liquid-cooling device 11*b* shown in FIG. 5 are hotter than the airflow that has cooled the exposure unit 8. Thus, the radiators 125*a* can be cooled with the same airflow that has been used to cool the exposure unit 9.

Therefore, in the present embodiment, the airflow that has passed through at least one of the radiators 115*a* of the first liquid-cooling device 11*a* is used to cool a heat releaser that releases the heat from the exposure unit 9 and is then used to cool at least one of the radiators 125*a* of the second liquid-cooling device 11*b*.

FIG. 7 schematically illustrates a configuration around the exposure unit 9 shown in FIG. 1. The lower side and the upper side in FIG. 7 are respectively the front side and the back side of the image forming apparatus 300, and sheets are fed from right to left in FIG. 7.

As shown in FIG. 7, the four cooling units 115 of the first liquid-cooling unit 11*a* are disposed on the right side, and four cooling units 125 of the second liquid-cooling unit 11*b* are disposed on the left side in FIG. 7. Further, four sets of heat release fins 98Y, 98M, 98C, and 98K, serving as second heated portions, are provided on the front side of the exposure unit 9, that is, on the lower side in FIG. 7. The heat release fins 98Y, 98M, 98C, and 98K are attached to the CPUs implemented on the control board, not shown, to control the light sources. The heat release fins 98Y, 98M, 98C, and 98K release the heat from the CPUs. A duct 99 is provided between (a) the cooling unit 115-4 (hereinafter also "extreme-downstream cooling unit") disposed at the extreme downstream end in the coolant flow direction among the cooling units 115 of the first liquid-cooling device 11*a*, and (b) the cooling unit 125-1 (hereinafter also "extreme-upstream cooling unit"), disposed at the extreme upstream end in the coolant flow direction among the cooling units 125 of the second liquid-cooling device 11*b*. Four holes are formed in the duct 99 to accommodate the heat release fins 98 at least partially within the duct 99.

The four cooling units 115 of the first liquid-cooling device 11*a* are disposed on the sheet feed side (right side in FIG. 7) away from the fixing device 7 shown in FIG. 1. Therefore, the radiators 115*a* in the cooling units 115 can be less likely to be heated by the heat from the fixing device 7 or the heat from the discharge tray 8*e*.

The cooling units 115 of the first liquid-cooling device 11*a* take in external air and cool the radiators 115*a* with the external air. By contrast, the cooling units 125 of the second liquid-cooling device 11*b* takes air inside the apparatus and cools the radiators 125*a* with the internal air, which is then discharged outside the apparatus. Moreover, the air taken by the cooling fan 115*b*-4 in the extreme downstream cooling unit 115-4 flows in the duct 99 after passing through the radiator (hereinafter also "extreme-downstream radiator") 115*a*-4. Then, the air forcibly cools the heat release fins 98K, 98C, 98M, and 98Y sequentially while flowing inside the duct 99 from the right to the left in FIG. 7, which is hereinafter referred to as airflow direction in the duct, after which the air is sent to the extreme-upstream cooling unit 125-1 in the second liquid-cooling device 11*b*. The air sent to the cooling unit 125-1 cools the radiator (hereinafter also "extreme-upstream radiator") 125*a*-1 therein forcibly and then is discharged outside.

Guiding the air that has passed through the extreme-downstream radiator 115*a*-4 to the duct 99A can be advantageous as follows: Because the coolant flows to the cooling unit 115-4 after being cooled in the three cooling units 115 disposed upstream from the cooling unit 115-4 in the coolant flow direction, the temperature of the extreme-downstream radiator 115*a*-4 is lower than that of the radiators (hereinafter "upstream radiators") 115*a* in the cooling units 115-1 through 115-3. Therefore, the temperature of the air that has passed through the extreme-downstream radiator 115*a*-4 is lower than that of the air that has passed through any of the upstream radiators 115*a*. Thus, the heat release fins 98 can be cooled better by guiding the air that has passed through the extreme-downstream radiator 115*a*-4 to the duct 99, and accordingly efficiency in cooling the exposure unit 9 is higher, compared with a case in which the air that has passed through any of the upstream radiators 115*a* is sent to the duct 99.

Additionally, cooling the extreme-upstream radiator 125*a*-1 among the four radiators 125*a* in the second liquid-cooling device 11*b* with the airflow from the duct 99 can be advantageous as follows: Because the coolant heated by the heat from the sheets via the transport roller 8*a* initially flows to the extreme-upstream radiator 125*a*-1, the extreme-upstream radiator 125*a*-1 is hotter than the radiators (hereinafter "downstream radiators") 125*a*-2 through 125*a*-4. The temperature of the air from the duct 99 is increased by the heat from the heat release fins 98. Therefore, differences in the temperature between the air from the duct 99 and the radiators 125*a* are largest in the extreme-upstream radiator 125*a*-1. Accordingly, the radiator 125*a*-1 can be cooled with greater effect with the air from the duct 99 than the downstream radiators 125*a* are.

Figure 8:
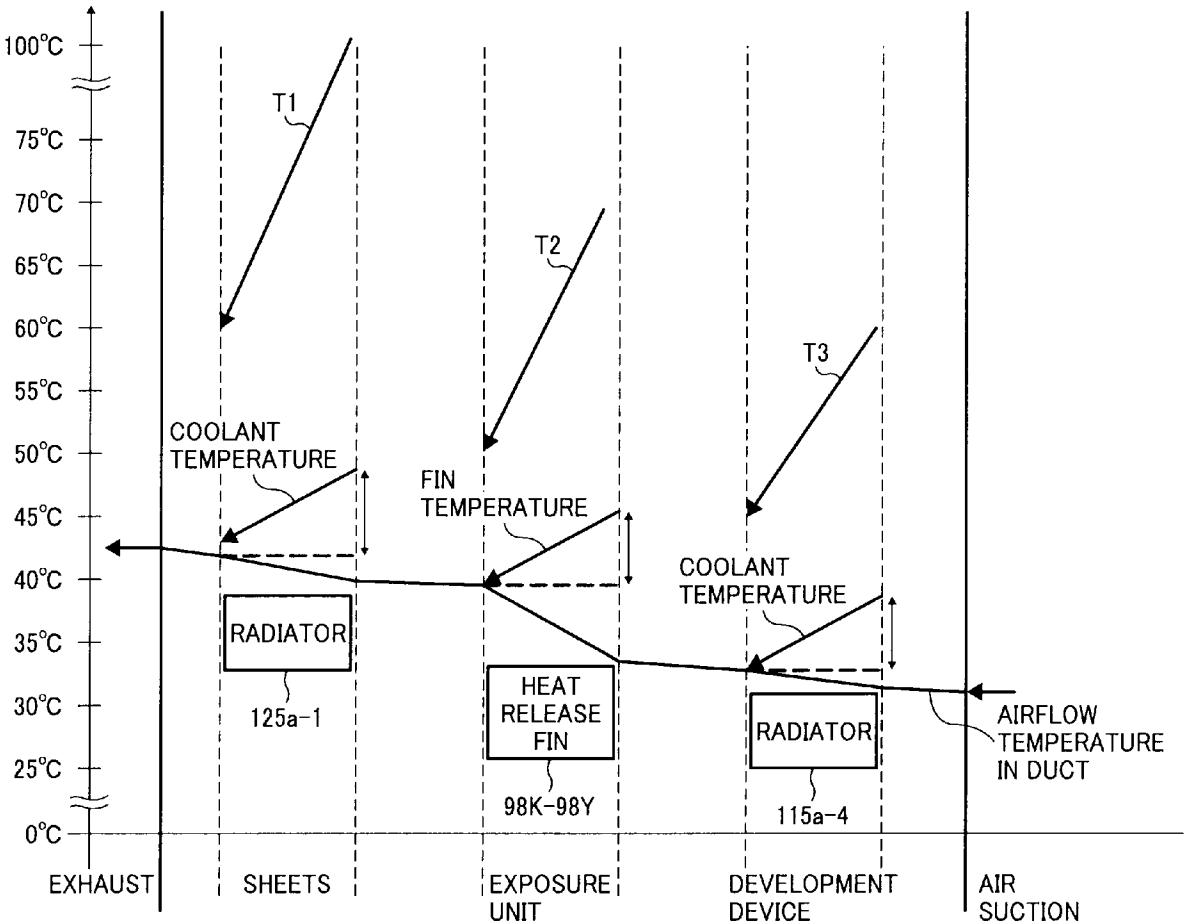
FIG. 8 is a graph illustrating changes in temperature of air flowing through a duct, heated portions of the image forming apparatus, and heat releasers shown in FIG. 7.

FIG. 8 is a graph illustrating changes in the temperature of the air flowing through the duct 99, the heated portions, and the heat releasers measured in an experiment. In FIG. 8, reference characters T1, T2, and T3 respectively represent the temperature of the heated portions, namely, the sheet after the fixing process, inside the exposure unit 9, and the development unit 19Y. As the temperature T1, the temperature of the sheet were measured before and immediately after the sheet passed through the first transport roller 8*a*. It is to be noted that the results shown in FIG. 8 are only examples.

Regarding the temperatures of the heat releasers, "fin temperature" represents a mean value of the temperatures of the four heat release fins 98, and the temperature of the coolant passing through radiators 115*a*-4 and 125*a*-1 was measured as the temperature of the radiators 115*a*-4 and 125*a*-1 (shown as "coolant temperature" in FIG. 8). More specifically, Misumi temperature measuring instruments were placed both immediately upstream from an inlet where the coolant entered the radiator 115*a*-4 or 125*a*-1 and immediately downstream from an outlet where the coolant exited from the radiator 115*a*-4 or 125*a*-1, and the temperature measuring instruments were connected to a recorder.

To measure the temperature of the air flowing through the duct 99, multiple thermocouples manufactured by Ishikawa Sangyo were placed inside the duct 99. More specifically, thermocouples were respectively placed on an upstream side and a downstream side of the radiator 115*a*-4, an upstream side of the heat release fin 98K, a downstream side of the heat release fin 98Y, and an upstream side and a downstream side of the radiator 125*a*-1 in the airflow direction in the duct 99, and the thermocouples were connected to a recorder. Thus, the temperature of the airflow was measured before and after passing through the radiator 115*a*-4, the heat release fins 98K through 98Y, and the radiator 125*a*-1.

In the experiment, printing was executed for a given time period while the first liquid-cooling device 11*a* was not operated until the development unit 19Y and the exposure unit 9 were sufficiently heated. Then, to measure the temperatures of the development unit 19Y and inside the exposure unit 9, printing was executed for a given time period while both the first and the second liquid-cooling devices 11*a* and 11*b* operated. The above-described temperature of the airflow in the duct 99 shows the changes in the temperature during this operation. In this operation, rotational frequency of the cooling fans 115*b* and 125*b* in the first and the second liquid-cooling devices 11*a* and 11*b* was set so that the development device 19Y was heated to 45° C. within a predetermined or given time period.

As shown in FIG. 8, in the experiment, the coolant was cooled from 37° C. to 34° C. while passing through the radiator 115*a*-4. Simultaneously, the air in the duct 99 that passed the radiator 115*a*-4 was heated from 32° C. to 34° C., after which the air flowing in the duct 99 was heated to a certain degree by the temperature inside the apparatus before reaching the heat release fin 98K disposed upstream from other heat release fins. Then, while flowing in the duct 99, the air drew heat from the heat release fins 98 and thus was heated to 39° C. Before cooled by the air flowing in the duct 99, a mean temperature of the heat release fins 98K through 98Y was 45° C., and thus higher than the temperature of the air that passed through the radiator 115*a*-4 (34° C.). Therefore, the air after passing through the radiator 115*a*-4 could forcibly cool the heat release fins 98 sufficiently. As a result, the exposure unit 9 was sufficiently cooled, as the temperature inside which was decreased from 70° C. to 50° C.

The air that drew heat from the heat release fins 98, thus heated to 39° C., was heated to a certain degree before it reached the extreme-upstream cooling unit 125-1 in the second liquid-cooling device 11*b*. While passing through the extreme-upstream radiator 125*a*-1, the air was heated from 40° C. to 42° C. At that time, because the temperature (48° C.) of the coolant immediately before entering the radiator 125*a*-1 was higher than the temperature (39° C.) of the air that passed the heat release fin 98Y, the air that passed the heat release fin 98Y could forcibly cool the radiator 125*a*-1 in the second liquid-cooling device 11*b* sufficiently. As a result, the sheet was cooled from 70° C. to 50° C., and thus the sheet serving as a third heated portion could be cooled sufficiently.

By contrast, if the flow of the air is reversed, the air flows from the hotter heated portion to the heated portion whose temperature is lower, namely, from the radiator 125*a*-1 (48° C.) of the first liquid-cooling device 11*b* via the heat release fins 98K through 98Y, whose mean temperature before cooling is 45° C. to the extreme-downstream radiator 115*a*-4 (37° C.) of the first liquid-cooling device 11*a*. Because the air that has passed through the extreme-upstream radiator 125*a*-1 of the second liquid-cooling device 11*b* is hotter than the heat release fins 98 and the extreme-downstream radiator 115*a*-4 of the first liquid-cooling device 11*a*, it is possible that the heat release fins 98 as well as the radiator 125*a*-1 might be heated by the air in the duct 99 adversely, rather than cooled. As a result, the exposure unit 9, the development units 19, and the sheet cannot be cooled sufficiently. Therefore, by guiding the air from the heated portion whose temperature is lower to the hotter heated portion as in the present embodiment, the exposure unit 9, the development units 19, and the sheet can be reliably cooled.

In the present embodiment, external air taken in the apparatus by the cooling fan 115*b* of the first liquid-cooling device 11*a* is sent to the heat release fins 98 of the exposure unit 9 so as to cool the heat release fins 98, thus obviating the need for a separate cooling fan to cool the heat release fins 98. As the number of the fans is thus reduced, noise as well as the energy consumption by the apparatus can be reduced. Moreover, in this configuration, an identical duct with an air suction port can be used to suck in air to cool the heat release fins 98 and then to exhaust the air heated by the heat release fins 98 outside as well as to suck in air to cool the radiator of the liquid-cooling device and then to exhaust the air heated by the radiator outside. Thus, the number of components can be reduced, thereby reducing the cost as well as the size of the apparatus.

Additionally, because the radiators 115*a* of the first liquid-cooling device 11*a* are disposed on the sheet feed side (right side in FIG. 7) away from the fixing device 7 and the discharge tray 8*e* shown in FIG. 1, efficiency in cooling the development devices 19 is not decreased by the heat from the fixing device 7 and the discharge tray 8*e*, and the increase in the temperature of the air that has passed the extreme-downstream radiator 115*a*-4 can be restricted. Accordingly, sufficient efficiency in cooling the heat release fins 98 as well as the sheet can be maintained.

It is to be noted that, although the description above concerns a configuration using both the cooling fan 115*b*-4 of the first liquid-cooling device 11*a* and the cooling fan 125*b*-1 of the second liquid-cooling device 11*b*, alternatively, the image forming apparatus 300 can include only one of the two fans. Even with only one of them, external air can flow sequentially through the extreme-downstream radiator 115*a*-4 of the first liquid-cooling device 11, the heat release fins 98, and the extreme-upstream radiator 125*a*-1 of the second liquid-cooling device 11*b*, and then be discharged to the outside of the apparatus.

Additionally, because the temperature of the air that has cooled the upstream radiators 115*a*-1 through 115*a*-3 increases by only limited degrees, instead of discharging the air outside, alternatively, the air can be used to cool another heated portion, such as the driving motor to drive the photoconductors 18, the reading unit 10, or the like.

Figure 9:
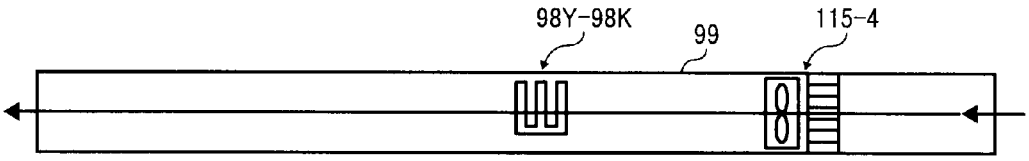
FIG. 9 illustrates a configuration of a cooling system in which air that has passed heat release fins is discharged outside the apparatus.
Figure 10:
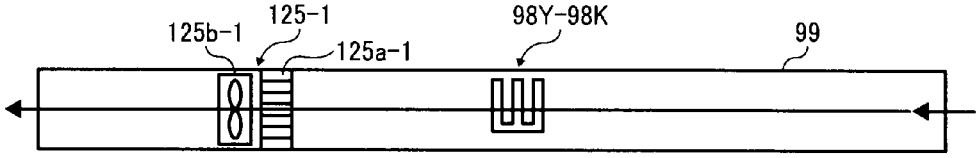
FIG. 10 illustrates another configuration of the cooling system in which external air sucked into the apparatus is sent to the heat release fins without passing through a radiator of the first liquid-cooling device.

By contrast, as shown in FIG. 9, the air that has passed the heat release fins 98 may be discharged outside, instead of flowing to the radiator 125*a* of the second liquid cooling unit 11*b* as shown in FIG. 7. Alternatively, as shown in FIG. 10, external air sucked in by a cooling fan may be sent though the duct 99, without passing through the radiator 115*a* of the first liquid-cooling device 11*a*, directly to the heat release fins 98 and further to the cooling unit 125-1 of the second liquid cooling unit 11*b*. It is to be noted that, in this case, the position of the cooling fan 125*b*-1 in the duct 99 is not limited to the position shown in FIG. 10, and alternatively, the cooling fan 125*b*-1 may be disposed, for example, upstream from the heat release fins 98 in the airflow direction in the duct 99.

Figure 11:
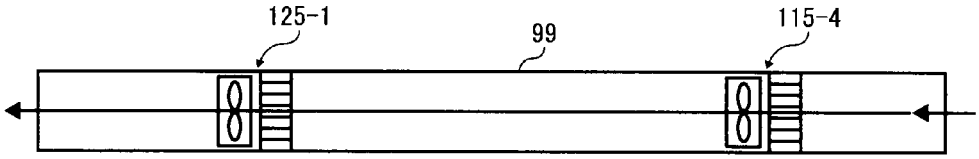
FIG. 11 illustrates another configuration of the cooling system in which air that has passed the radiator of the first liquid-cooling device is sent to a radiator of the second liquid-cooling device without passing through the heat release fins.

Yet alternatively, as shown in FIG. 11, the air that has passed through the radiator 115*a*-4 of the first liquid-cooling device 11 may be sent to the radiator 125*a*-1 of the second liquid cooling unit 11*b*, without passing by the heat release fins 98. In this configuration, the radiator 125*a*-1 serves as the second heated portion.

In the present embodiments, although the rotational frequency of the cooling fans 115*b* in the first liquid-cooling device 11*a* can be set to raise the temperature of the development devices 19 to 45° C. within a predetermined or given time period, the amount of the air flowing through the duct 99 may be excessive when the cooling fans 115*b* rotate at such a rotational frequency. If the amount of the air flowing through the duct 99 is excessive, air turbulence can result, causing air pressure around the heat release fins 98 to drop, which decreases the speed of the airflow. If the air flow speed is slowed, the air might fail to sufficiently cool the heat release fins 98 and the radiator 125*a*-1 of the second liquid-cooling device 11*b*, thus decreasing the cooling efficiency of the exposure unit 9 and the sheet.

Figure 12:
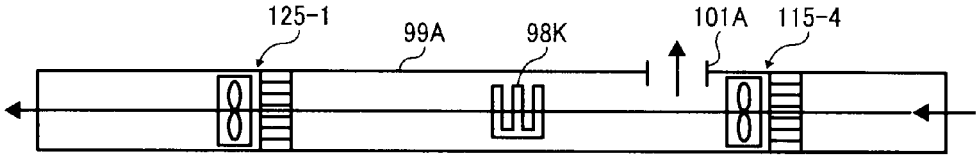
FIG. 12 illustrates another configuration of the cooling system in which a flow-in bypass is provided in the duct.

Therefore, as shown in FIG. 12, a duct 99A includes a discharge bypass 101A, serving as an airflow amount adjuster, provided between the extreme-downstream cooling unit 115-4 of the first liquid-cooling unit 11*a* and the heat release fin 98K. With the discharge bypass 101A, when the amount of the airflow in the duct 99A is excessive, the air can be partly diverted by the discharge bypass 101A, and thus the amount of airflow in the duct 99A can be adjusted to a predetermined or given amount. Thus, the drop in the pressure around the heat release fins 98 described above can be prevented, and a constant airflow speed can be maintained. As a result, the heat release fins 98 and the radiator 125*a*-1 of the second liquid-cooling device 11*b* can be cooled sufficiently, and cooling efficiency of the exposure unit 9 and the sheet does not decrease.

Additionally, the bypass 101A may be extended to another heated portion such as the driving motor to so as to cool it with the air discharged from the duct 99A, flowing through the bypass 101A, which can increase cooling efficiency of whole the apparatus.

Moreover, even when the amount of the air flowing to the heat release fins 98 is within a desired amount, that amount might be insufficient for the extreme-upstream cooling unit 125-1 of the second liquid-cooling device 11*b* to cool the sheet to a predetermined or given temperature. If the rotational frequency of the cooling fan 125*b*-1 in the extreme-upstream cooling unit 125-1 is increased in this state to compensate for the shortage of the air, although the amount of the air flowing to the cooling unit 125-1 may be increase initially, pressure might drop around the heat release fins 98. Then, the amount of the air flowing to the extreme-upstream cooling unit 125-1 of the second liquid-cooling device 11*b* might decrease further.

Figure 13:
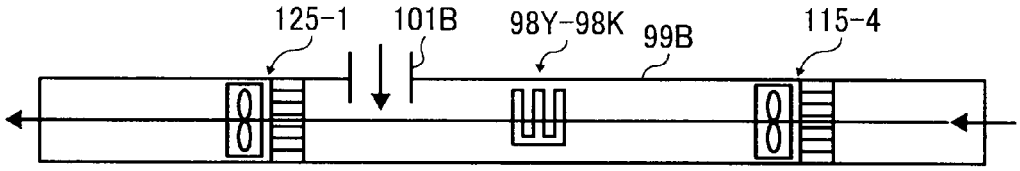
FIG. 13 illustrates another configuration of the cooling system in which a discharge bypass is provided in the duct.

In view of the foregoing, as shown in FIG. 13, a flow-in bypass 101B, serving as an airflow amount adjuster, can be provided between the heat release fin 98Y and the second liquid-cooling device 11*b* in a duct 99B. In the configuration shown in FIG. 13, when the rotational frequency of the cooling fan 125*b*-1 in the extreme-upstream cooling unit 125-1 is increased, air flows from the flow-in bypass 101B into the duct 99B, and thus the amount of the air flowing to the extreme-upstream radiator 125*a*-1 in the cooling unit 125-1 is increased. As a result, the sheet can be sufficiently cooled. Moreover, even when the rotational frequency of the cooling fan 125*b*-1 is increased to increase the amount of the air flowing to the cooling unit 125-1, pressure does not drop around the heat release fins 98. Accordingly, the air flows through the heat release fins 98 at a predetermined constant speed, preventing the cooling efficiency of the exposure unit 9 from decreasing.

Figure 14:
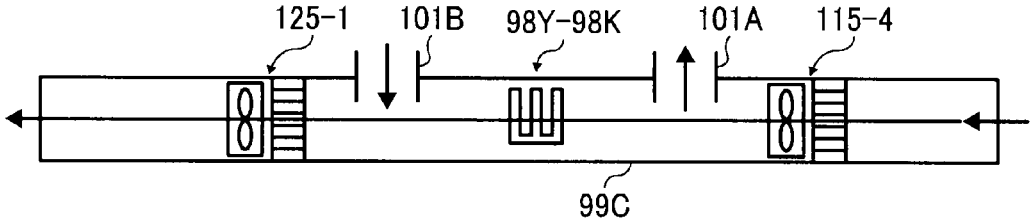
FIG. 14 illustrates another configuration of the cooling system in which both the flow-in bypass and the discharge bypass are provided in the duct.

Moreover, both the discharge bypass and the flow-in bypass can be connected to the duct as shown in FIG. 14. Referring to FIG. 14, by using a duct 99C connected to a discharge bypass 101A as well as a flow-in bypass 101B, even when the amount of the air flowing to the extreme-downstream cooling unit 115-4 in the first liquid-cooling device 11*a* increases, a constant amount of air can flow to the heat release fins 98. Additionally, the air flowing to the extreme-upstream cooling unit 125-1 in the second liquid-cooling device 11*b* can be increased without changing the amount of the air flowing through the heat release fins 98 nor increasing the speed at which the air flows through the heat release fins 98. Thus, the development devices, the exposure unit, and the sheets can be reliably cooled to a predetermined or given temperature. In this configuration, both the discharge bypass 101A and the flow-in bypass 101B serve as the airflow amount adjusters.

It is to be noted that, the above-described various embodiments of the present invention are not limited to intermediate-transfer tandem image forming apparatuses but are equally applicable to direct-transfer tandem image forming apparatuses.

Figure 15:
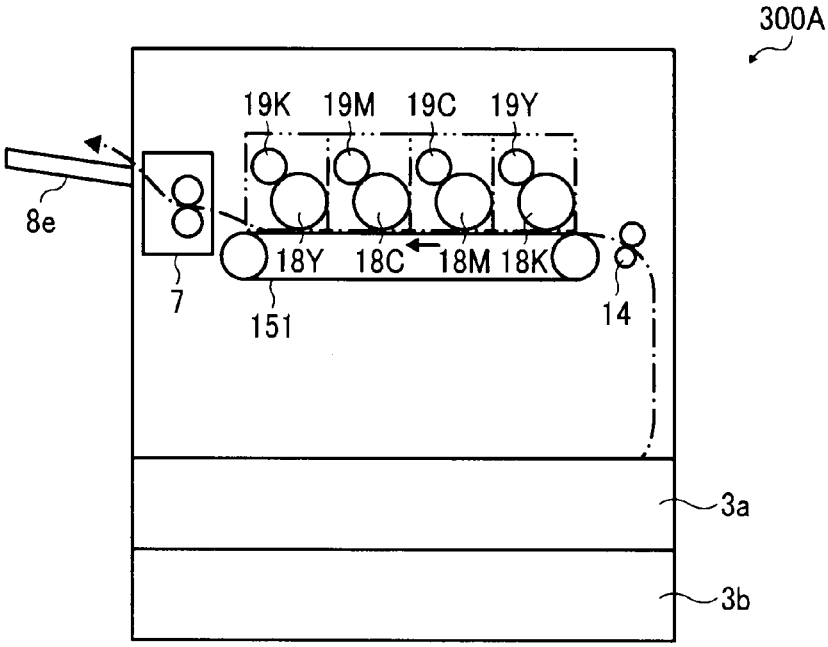
FIG. 15 is a schematic diagram illustrating a configuration of a direct-transfer tandem image forming apparatus.

FIG. 15 illustrates a configuration of a direct-transfer tandem image forming apparatus 300A. Referring to FIG. 15, although not shown in FIG. 15, each heat receiving plate 112 of the first liquid-cooling device 11*a* shown in FIG. 3 can be disposed contacting a lower portion of corresponding development device 19, and the second liquid-cooling device 11*b* shown in FIG. 5 can be disposed close to a fixing device 7 similarly to the configuration shown in FIG. 1.

In the image forming apparatus 300A, while latent images are formed on rotating photoconductors 18Y, 18C, 18M, and 18K and then developed by the development devices 19Y, 19C, 19M, and 19K into yellow, cyan, magenta, and black single-color toner images, a sheet contained in sheet cassettes 3*a* or 3*b* is fed toward a pair of registration rollers 14. Then, the registration rollers 14 forward the sheet to a transfer belt 151, timed to coincide with the movement of the toner images on the photoconductors 18. In the configuration shown in FIG. 15, while the sheet is transported by the transfer belt 151 that rotates counterclockwise in FIG. 15, the yellow toner image is initially transferred from the photoconductor 18Y directly onto the sheet. Then, the cyan, magenta, and black images are sequentially transferred from the photoconductors 18C, 18M, and 18K and superimposed one on another on the yellow image on the sheet, forming a multicolor image on the sheet, after which the toner image is fixed on the sheet by the fixing device 7.

As described above, the various embodiments of the present invention use the first liquid-cooling unit including the first cooling fan and the first radiator serving as the heat releaser to cool the first heated portion. The air taken in the apparatus by the cooling fan to cool the radiator is sent to the heat release fins 98, serving as the second heated portion, that is different from the first heated portion. This configuration can obviate the need for a separate cooling fan for the heat release fins.

When the second heated portion is hotter than the heat releaser for the first heated portion, the first heat releaser for the first heated portion is disposed upstream from the second heated portion in the airflow direction in the duct 99. In the configuration shown in FIG. 7, the radiator 115*a*-4, serving as the first heat releaser for the first heated portion (development devices 19), is disposed, in the airflow direction in the duct 99, upstream from the heat release fins 98, serving as the second heated portion, that is hotter than the radiator 115*a*-4. Therefore, the air that has passed the radiator 115*a*-4 can be cooler than the heat release fins 98.

By contrast, when the second heated portion is cooler than the first heat releaser for the first heated portion, the first heat releaser is disposed downstream from the second heated portion in the airflow direction in the duct 99. In this case, the radiator 125*a*-1 and the heat release fins 98 shown in FIG. 10 respectively correspond to the first heat releaser and the second heated portion, and the radiator 125*a*-1 is disposed downstream from the heat release fins 98 in the airflow direction in the duct 99. Therefore, the air that has passed the heat release fins 98 can be cooler than the radiator 125*a*-1.

Thus, in both of the above two cases, the first and the second heated portions can be reliably cooled.

Additionally, the second liquid-cooling device including the second cooling fan and the second heat releaser (e.g., radiator) is used to cool the third heated portion. The second heat releaser becomes hotter than the second heated portion (heat release fins). The air that has cooled the second heated portion flows to the second radiator. In this configuration, because the air that has cooled the second heated portion is not hotter than the second heat releaser, the second heated portion as well as the third heated portion can be reliably cooled. Additionally, the amount of air flowing to the heat release fins can be adjusted by connecting the airflow amount adjuster to the duct 99.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

an image forming unit including an image carrier on which a latent image is formed and a development device to develop the latent image;

a transfer unit to transfer the image from the image carrier onto a sheet of recording media;

a fixing device to fix the image on the sheet;

a sheet transport unit to transport the sheet transported from the fixing device;

a sheet stack portion on which the sheet on which the image is fixed is stacked;

an air duct; and a liquid-cooling device, the liquid-cooling device comprising:

a heat receiving member disposed in thermal contact with a first heated portion of the image forming apparatus, the heat receiving member including a coolant flow path through which a coolant flows;

a heat releaser to release heat from the coolant;

a circulation pipe connecting the heat receiving member and the heat releaser to circulate the coolant therebetween;

a transport member connected to the circulation pipe to transport the coolant through the circulation pipe; and an airflow generator to generate airflow with external air taken into the image forming apparatus to cool the heat releaser, wherein the air duct guides the air taken by the airflow generator to a second heated portion of the image forming apparatus.

2. The image forming apparatus according to claim 1, wherein the second heated portion is hotter than the heat releaser, and the heat releaser is disposed upstream from the second heated portion in a direction in which the air taken in by the airflow generator flows through the air duct.

3. The image forming apparatus according to claim 2, wherein the first heated portion is the image forming unit including the image carrier and the development device.

4. The image forming apparatus according to claim 2, wherein the heat releaser is disposed not to receive heat from the fixing device.

5. The image forming apparatus according to claim 2, wherein the heat releaser is disposed not to receive the heat from the sheet on which the image is formed.

6. The image forming apparatus according to claim 2, further comprising a second liquid-cooling device to cool a third heated portion hotter than the second heated portion, the second liquid-cooling device comprising:

a second heat receiving member disposed in thermal contact with the third heated portion, the second heat receiving member including a coolant flow path through which a coolant flows;

a second heat releaser to release heat from the coolant that cools the third heated portion via the second heat receiving member;

a second circulation pipe connecting the second heat receiving member and the second heat releaser to circulate the coolant therebetween; and a second transport member connected to the second circulation pipe to transport the coolant through the second circulation pipe, wherein the second heat releaser is hotter than the second heated portion and is disposed downstream from the second heated portion in the direction in which the air taken in by the airflow generator flows through the air duct.

7. The image forming apparatus according to claim 6, wherein the first heated portion is the image forming unit including the image carrier and the development device.

8. The image forming apparatus according to claim 7, wherein the second liquid-cooling device cools at least one of the fixing device, a vicinity of the fixing device, the sheet on which the image is formed, the sheet transport unit, and the sheet stack portion.

9. The image forming apparatus according to claim 1, wherein the air duct comprises an airflow amount adjuster to adjust the amount of air flowing in the air duct to the second heated portion.

10. The image forming apparatus according to claim 1, wherein the heat releaser is hotter than the second heated portion, and the heat releaser is disposed downstream from the second heated portion in a direction in which the air taken in by the airflow generator flows through the air duct.

11. The image forming apparatus according to claim 10, wherein the liquid-cooling device cools at least one of the fixing device, vicinity of the fixing device, the sheet on which the image is formed, the sheet transport unit, and the sheet stack portion.

12. A cooling method used in an image forming apparatus:

the image forming apparatus comprising an image forming unit including an image carrier and a development device, a transfer unit, and a fixing device, the method comprising:

generating an airflow with external air taken into the image forming apparatus by an airflow generator;

drawing heat from a first heated portion of the image forming apparatus by a heat receiving member;

transmitting the heat from the first heat receiving member to a heat releaser;

cooling the heat releaser with the air taken into the image forming apparatus; and guiding the air that has cooled the heat releaser through an air duct of the image forming apparatus to a second heated portion of the image forming apparatus to cool the second heated portion with the air that has cooled the heat releaser.

13. The cooling method according to claim 12, wherein the second heated portion is hotter than the heat releaser, and the heat releaser is disposed upstream from the second heated portion in a direction in which the air taken by the airflow generator flows through the air duct.

14. The cooling method according to claim 13, wherein the first heated portion is the image forming unit including the image carrier and the development device.

15. The cooling method according to claim 13, further comprising:

drawing heat by a second heat receiving member from a third heated portion of the image forming apparatus, the third heated portion hotter than the second heated portion;

transmitting the heat from the second heat receiving member to a second heat releaser;

guiding the air that has cooled the second heated portion to a second heat releaser heated by the heat from the third heated portion; and cooling the second heat releaser with the air that has cooled the second heated portion;

wherein the second heat releaser is hotter than the second heated portion and is disposed downstream from the second heated portion in the direction in which the air taken in by the airflow generator flows through the air duct.

16. The cooling method according to claim 15, wherein the first heated portion is the image forming unit including the image carrier and the development device.

17. The cooling method according to claim 15, wherein the third heated portion is at least one of the fixing device, vicinity of the fixing device, a recording medium on which an image is fixed, a sheet transport unit to transport the recording medium transported from the fixing device, and a sheet stack portion on which the recording medium is stacked after the image is fixed thereon.

18. The cooling method according to claim 12, further comprising:

adjusting the amount of air flowing through the air duct to the second heated portion.

19. The cooling method according to claim 12, wherein the heat releaser is hotter than the second heated portion, and the heat releaser is disposed downstream from the second heated portion in a direction in which the air taken by the airflow generator flows through the air duct.

20. The cooling method according to claim 19, wherein the liquid-cooling device cools at least one of the fixing device, vicinity of the fixing device, the recording medium on which the image is formed, a sheet transport unit to transport the medium transported from the fixing device, and a sheet stack portion on which the medium is stacked after the image is fixed thereon.

* * * * *